US007305826B2

(12) United States Patent
Kuster

(10) Patent No.: US 7,305,826 B2
(45) Date of Patent: Dec. 11, 2007

(54) AXIAL LOADING MANAGEMENT IN TURBOMACHINERY

(75) Inventor: Kurt W. Kuster, Placentia, CA (US)

(73) Assignee: Honeywell International , Inc., Morristown, NJ (US)

( * ) Notice: Subject to any disclaimer, the term of this patent is extended or adjusted under 35 U.S.C. 154(b) by 161 days.

(21) Appl. No.: 11/059,424

(22) Filed: Feb. 16, 2005

(65) Prior Publication Data

US 2006/0179839 A1 Aug. 17, 2006

(51) Int. Cl.

| | |
|---|---|
| ***F02D 23/00*** | (2006.01) |
| ***F04D 29/44*** | (2006.01) |
| ***F04D 29/56*** | (2006.01) |
| ***F04D 29/38*** | (2006.01) |
| *F04D 29/46* | (2006.01) |
| *B63H 1/26* | (2006.01) |
| *B63H 7/02* | (2006.01) |

(52) U.S. Cl. ..... 60/602; 415/159; 415/163; 416/223 A

(58) Field of Classification Search ..... 60/602; 415/159–164; 416/233 A

See application file for complete search history.

(56) References Cited

U.S. PATENT DOCUMENTS

| | | | | |
|---|---|---|---|---|
| 81,474 | A * | 8/1868 | Bryson et al. | 415/159 |
| 3,232,581 | A | 2/1966 | Swearingen | 415/163 |
| 3,409,968 | A * | 11/1968 | Denes | 416/223 A |
| 3,495,921 | A | 2/1970 | Swearingen | 415/163 |
| 4,297,077 | A * | 10/1981 | Durgin et al. | 415/115 |
| 4,300,869 | A | 11/1981 | Swearingen | 415/160 |
| 4,378,960 | A * | 4/1983 | Lenz | 415/164 |
| 4,504,190 | A * | 3/1985 | Beeloo | 415/166 |
| 4,705,452 | A * | 11/1987 | Karadimas | 415/161 |
| 5,332,357 | A * | 7/1994 | Tubbs | 415/160 |
| 5,931,636 | A * | 8/1999 | Savage et al. | 415/160 |
| 6,419,464 | B1 * | 7/2002 | Arnold | 415/163 |
| 6,672,059 | B2 * | 1/2004 | Arnold | 60/602 |
| 7,059,129 | B2 * | 6/2006 | Zollinger et al. | 60/602 |
| 2005/0226718 | A1 * | 10/2005 | Marcis et al. | 415/163 |

FOREIGN PATENT DOCUMENTS

EP 589745 A1 * 3/1994

* cited by examiner

*Primary Examiner*—Thai-Ba Trieu
(74) *Attorney, Agent, or Firm*—Chris James

(57) ABSTRACT

Exemplary vanes for a turbocharger having variable nozzle geometries are disclosed. In one aspect, each of the vanes includes two axial surfaces that are on opposite sides of the vane. The opposite axial surfaces include two corresponding chambers. These chambers are partially exposed to each other through an aperture. Such an aperture allows for some degree of equalization of the pressures in the chambers and, thereby, reduces the axial load exerted by a vane, for example, on the unison ring. In another aspect, each of the vanes includes two opposite airfoil surfaces. At least one of the airfoil surfaces includes a notch that allows a chamber in the nozzle to be pressurized by the exhaust gas. The pressure in the chamber creates a counteracting force that reduces the axial load exerted by a vane.

15 Claims, 7 Drawing Sheets

AXIAL LOADING MANAGEMENT IN TURBOMACHINERY

TECHNICAL FIELD

Subject matter disclosed herein relates generally to turbomachinery and, more particularly, to the management of axial loading in turbochargers.

BACKGROUND

To achieve higher efficiency and output, some internal combustion engines use turbochargers to pressurize intake air. A turbocharger typically includes a compressor and a turbine, which are mechanically mounted onto a common shaft. The turbine extracts power from the heat and volumetric flow of the exhaust gas exiting the engine and the compressor applies the power to compress the intake air going into the engine. Specifically, the exhaust gas exiting the engine is routed into a turbine housing of a turbocharger in a manner that causes the turbine to spin. Since the compressor and the turbine are linked by the common shaft, the rotary action of the turbine causes the compressor to spin and pressurize the intake air to the engine.

Controlling the flow of exhaust gas to the turbine can improve the efficiency and the operational range of a turbocharger. To control the exhaust gas flow, the turbocharger may use a variable exhaust nozzle. One type of variable exhaust nozzle involves the use of multiple, pivoting nozzle vanes located annularly around the inlet to a turbine.

The turbocharger can control the positions of the pivoting nozzle vanes to alter the throat area of the passages between the nozzle vanes. By altering the throat area, the turbocharger can control the exhaust gas flow into the turbine. Typically, the turbocharger controls the positions of the pivoting nozzle vanes by rotating a unison ring that is mechanically connected to each of the nozzle vanes. The unison ring is typically located inside the turbine housing with the nozzle vanes, the turbine and other components.

The components inside the turbine housing may be manufactured with surfaces and cavities that can be pressurized by the exhaust gas to different air pressures. These differential gas pressures inside the turbine housing often lead to axial loading on the components. Excessive axial loading can cause increased friction between the components, which will lead to increased actuation response time and premature failure due to excessive wear.

Thus, there is a need to effectively manage axial loading on components inside the turbine housing in a turbocharger.

SUMMARY OF THE INVENTION

Vanes of this invention are included within a turbocharger having variable nozzle geometries. The vanes are oriented to direct exhaust gas to a turbine and are arranged within the turbine housing between a nozzle wall and a unison ring, which actuates the vanes. The unison ring receives an axial load exerted by the vanes and the exhaust gas passing between the vanes. In one aspect, each of the vanes comprises two axial surfaces that are on opposite sides of the vane. The opposite axial surfaces include two corresponding chambers. These chambers are partially exposed to each other through an aperture. This aperture equalizes the pressures in the chambers and, thereby, reduces the axial load on the unison ring.

In another aspect, each of the vanes includes two opposite airfoil surfaces. At least one of the airfoil surfaces includes a notch that allows a chamber in the cavity of the vane to be pressurized by the exhaust gas. The pressure in the cavity creates a counteracting force that reduces the axial load on the unison ring.

BRIEF DESCRIPTION OF THE DRAWINGS

A more complete understanding of the various methods, devices, systems, arrangements, etc., described herein, and equivalents thereof, may be had by reference to the following detailed description when taken in conjunction with the accompanying drawings wherein.

DETAIL DESCRIPTION

Various exemplary methods, devices, systems, arrangements, etc., disclosed herein address issues related to technology associated with turbochargers.

Figure 1:
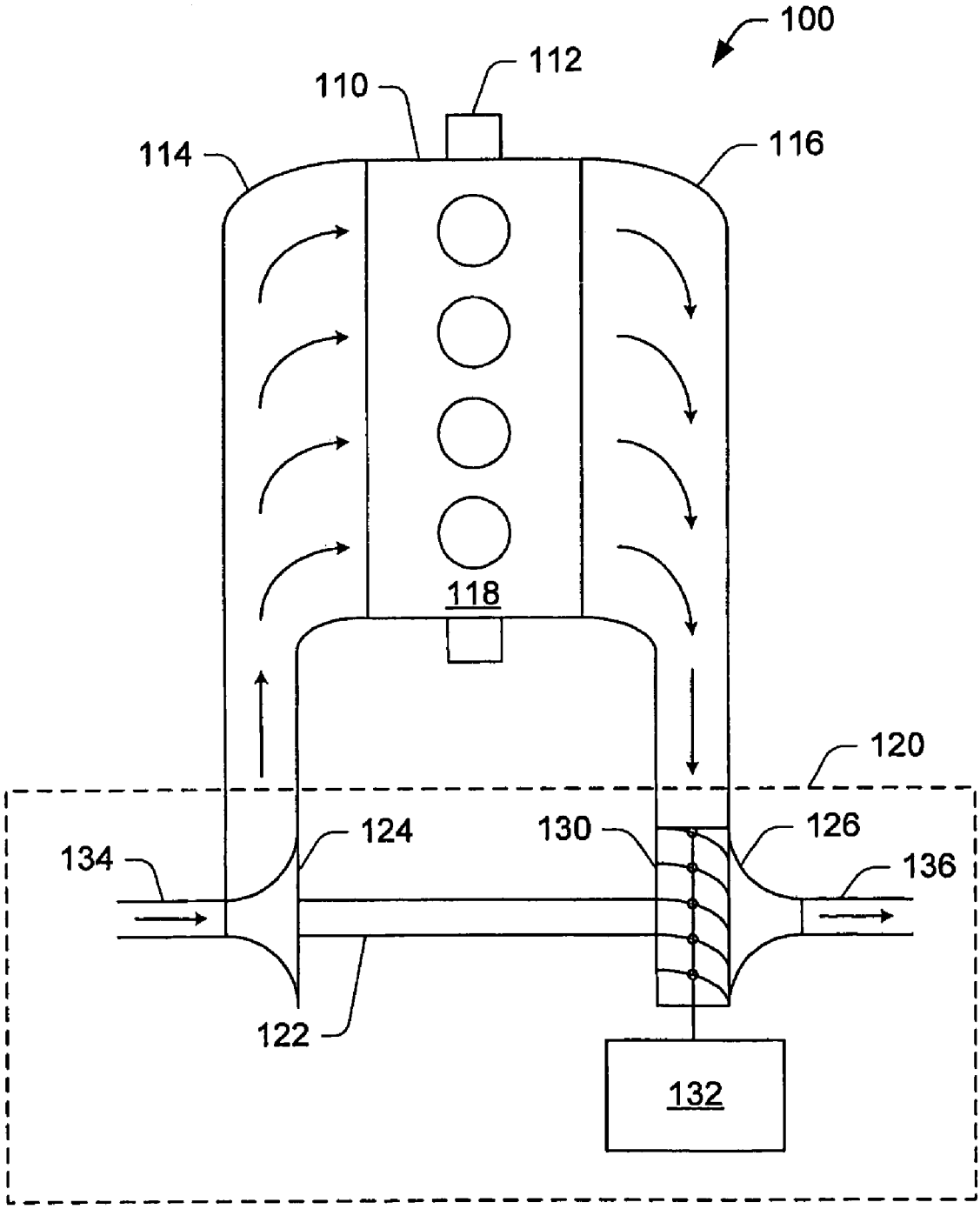
FIG. 1 (Prior Art)
FIG. 1 is an example system that includes an internal combustion engine and a turbocharger.

Turbochargers are frequently utilized to increase the output of an internal combustion engine. Referring to FIG. 1, an example system 100, including an example internal combustion engine 110 and an example turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust gas and to provide energy to intake air, which may be combined with fuel to form combustion gas. As shown in FIG. 1, the turbocharger 120 includes an air inlet 134, a shaft 122, a compressor 124, a turbine 126, a variable geometry unit 130, a variable geometry controller 132 and an exhaust outlet 136. The variable geometry unit 130 optionally has features such as those associated with commercially available variable geometry turbochargers (VGTs), such as, but not limited to, the GARRETT® VNT™ and AVNT™ turbochargers, which use multiple adjustable nozzle vanes to control the flow of exhaust across a turbine.

Adjustable nozzle vanes positioned at an inlet to a turbine typically operate to control flow of exhaust to the turbine. For example, GARRETT® VNT™ turbochargers adjust the exhaust flow at the inlet of a turbine in order to optimize turbine power with the required load. Movement of the nozzle vanes towards a closed position typically directs exhaust flow more tangentially to the turbine, which, in turn, imparts more energy to the turbine and, consequently, increases compressor boost. Conversely, movement of the nozzle vanes towards an open position typically directs exhaust flow in more radially to the turbine, which, in turn, reduces energy to the turbine and, consequently, decreases compressor boost. Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, a VGT may allow for boost pressure regulation which may effectively optimize power output, fuel efficiency, emissions, response, wear, etc. Of course, an exemplary turbocharger may employ wastegate technology as an alternative or in addition to aforementioned variable geometry technologies.

Figure 2:
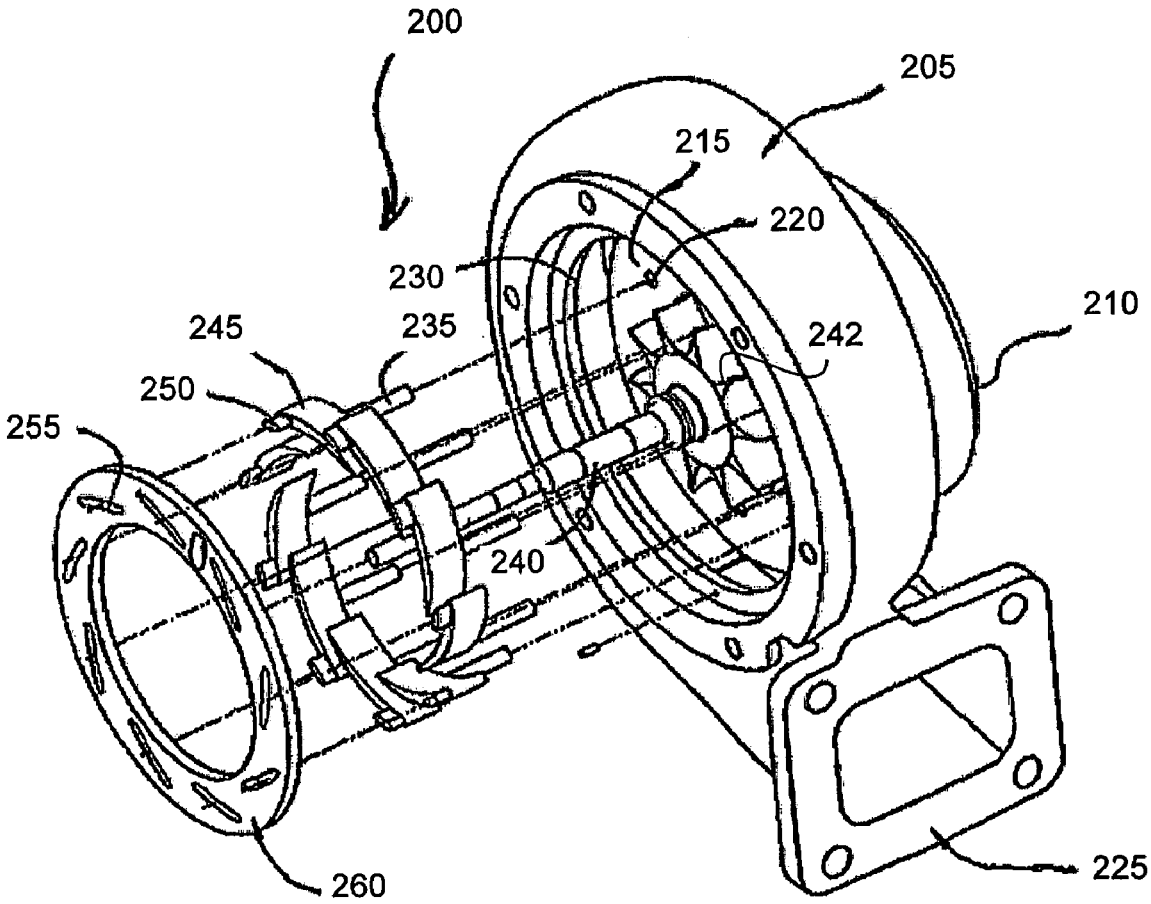
FIG. 2 (Prior Art)
FIG. 2 is an exploded view of an example variable geometry turbocharger.

FIG. 2 is an exploded view of an example variable geometry turbocharger 200. Variable geometry turbocharger 200 includes a turbine housing 205 having an inlet 225 for receiving an exhaust gas stream and an outlet 210 for directing exhaust gas to the exhaust system of an engine. A volute is connected to inlet 225 and an outer nozzle wall 215 is incorporated in turbine housing 205 adjacent to the volute. A turbine 242 is arranged within turbine housing 205. Turbine shaft 240 connects turbine 242 to a compressor that compresses inlet air to the engine. Exhaust gas from the engine enters turbine 242 through inlet 225 and is circumferentially distributed through the volute in turbine housing 205. The exhaust gas then enters through a circumferential nozzle entry 230 as substantially radial flow.

Multiple nozzle vanes 245 are mounted to a nozzle wall 215 by vane shafts 235 that project perpendicularly from the nozzle vanes 245. Vane shafts 235 are disposed within respective openings 220 in nozzle wall 215. Each of the nozzle vanes 245 includes an actuation tab 250 that projects from a side of the nozzle vane 245 opposite the vane shaft 235. Actuation tab 250 is engaged by a respective slot 255 in unison ring 260, which acts as a second nozzle wall.

An actuator assembly is connected with unison ring 260 and is configured to rotate unison ring 260 in one direction or the other as necessary to radially move nozzle vanes 245, with respect to an axis of rotation of turbine 242. Nozzle vanes 245 are outwardly or inwardly moved by the rotation of unison ring 260 to respectively increase or decrease pressure and adjust the flow direction of exhaust gas to the turbine. For example, as the unison ring is rotated, actuation tabs 250 are caused to move within their respectively slot 255 from one end of the slot to an opposite end. Since the slots 255 are oriented with a radial directional component along unison ring 260, the movement of actuation tabs 250 within slots 255 causes nozzle vanes 245 to pivot via rotation of vane shafts 235 within openings 220. The rotational direction of unison ring 260 determines whether the nozzle area is being opened or closed.

It is to be appreciated that the exhaust gas entering into the variable geometry turbocharger 200 through nozzle vanes 245 is highly pressurized. Components with surfaces that are directly and indirectly in contact with this pressurized exhaust gas are subjected to pressure loading. In particular, unison ring 260 is subjected to loading in the axial direction from the pressured exhaust gas. Since unison ring 260 has to rotate in order to properly actuate nozzle vanes 245, excessive axial loading on unison ring 260 can cause increased actuation response time and excessive wear.

Axial loading on unison ring 260 includes a component due to loading from nozzle vanes 245 and a component due loading from the exhaust gas in the passage between nozzle vanes 245. Data from an example analysis indicate that a significant contributor to unison ring loading is the component due to loading from nozzle vanes 245. The analysis also shows that this loading component can vary depending on the internal geometries of the nozzle vanes. Several example internal nozzle vane geometries and their characteristics will be discussed below in conjunction with FIGS. 3-5. Briefly stated, axial loading can be reduced by configuring the nozzle vanes with geometries such that pressures within the nozzle vane are properly managed.

Figure 3:
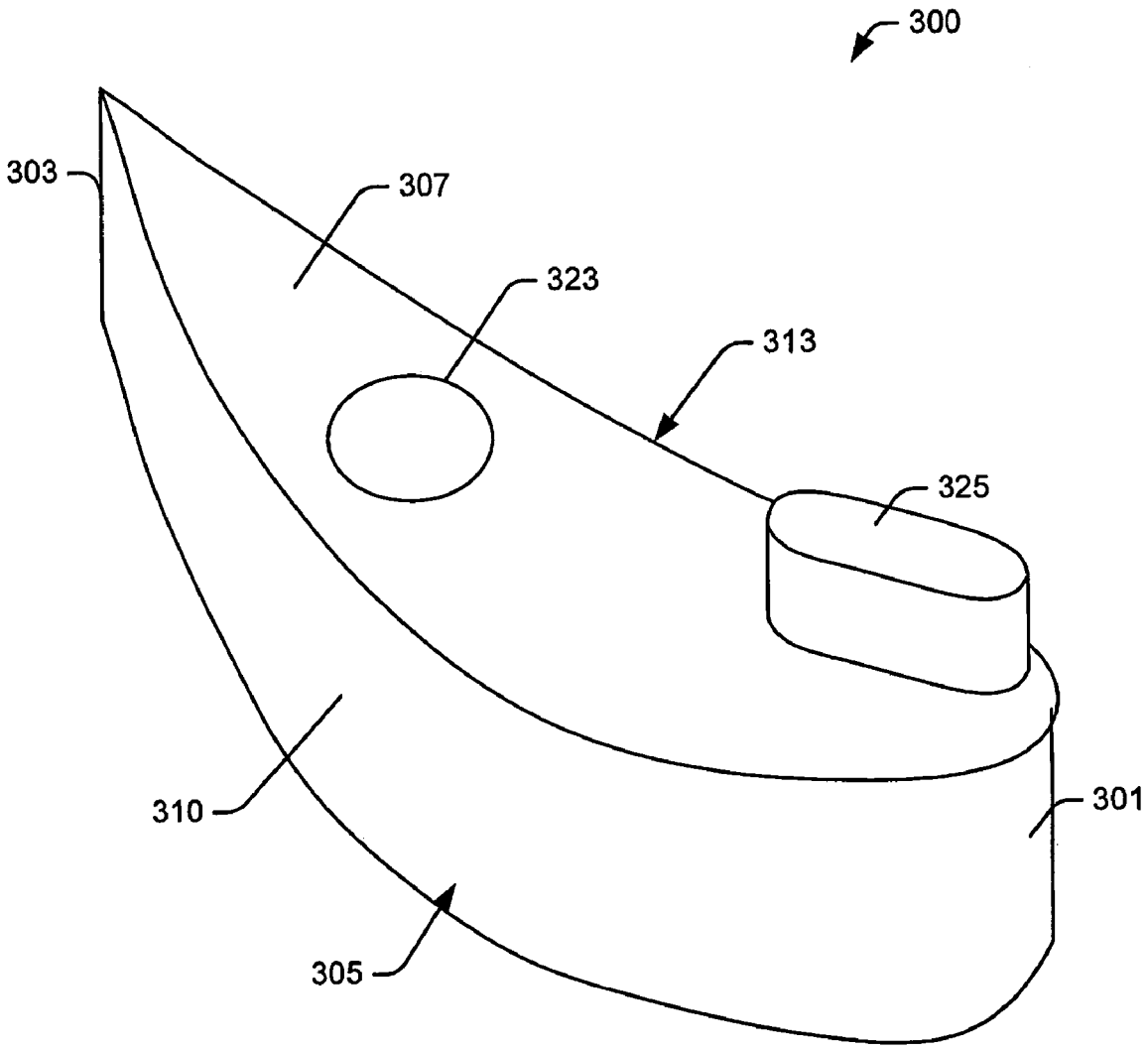
FIG. 3 (Prior Art)
FIG. 3 shows a prior art nozzle vane with a solid construction.

FIG. 3 shows a prior art nozzle vane 300 with a solid construction. Nozzle vane 300 includes a shaft opening 323 and an actuation tab 325. Shaft opening 323 is arranged to accommodate one end of a shaft on which nozzle vane 300 is pivoted. The other end of the shaft is inserted into a corresponding opening in the nozzle wall. Actuation tab 325 is fitted into a corresponding slot in the unison ring. In this configuration, the orientation of nozzle vane 300 may be adjusted by rotating the nozzle vane about the shaft in shaft opening 323. As stated above, the rotation of the unison ring causes the actuation tab 325 to move within a corresponding slot in the unison ring, which, in turn, causes the rotation of nozzle vane 300 about the shaft. Thus, the orientation of nozzle vane 300 can be adjusted by controlling the rotation of the unison ring.

Nozzle vane 300 also includes a leading edge 301, a trailing edge 303 (generally the portion of the vane positioned closest to a turbine wheel), an outer airfoil surface 310 extending between the leading edge 301 and the trailing edge 303, an inner airfoil surface 313 extending between the leading edge 301 and the trailing edge 303, a front axial surface 305, and a rear axial surface 307. For each nozzle vane, inner airfoil surface 313 and outer airfoil surface 310, along with surfaces on the nozzle wall and the unison ring in the turbine housing, are configured to create a passage for directing the exhaust gas into the turbine. Front axial surface 305 is oriented adjacent to the nozzle wall. Rear axial surface 307 is oriented opposite to front axial surface 307 and adjacent to the unison ring.

As shown in the figure, front axial surface 305 and rear axial surface 307 of the example nozzle vane 300 are solid surfaces. Analysis has shown that a nozzle vane with such solid surfaces can generate a substantial axial load onto the unison ring.

Figure 4:
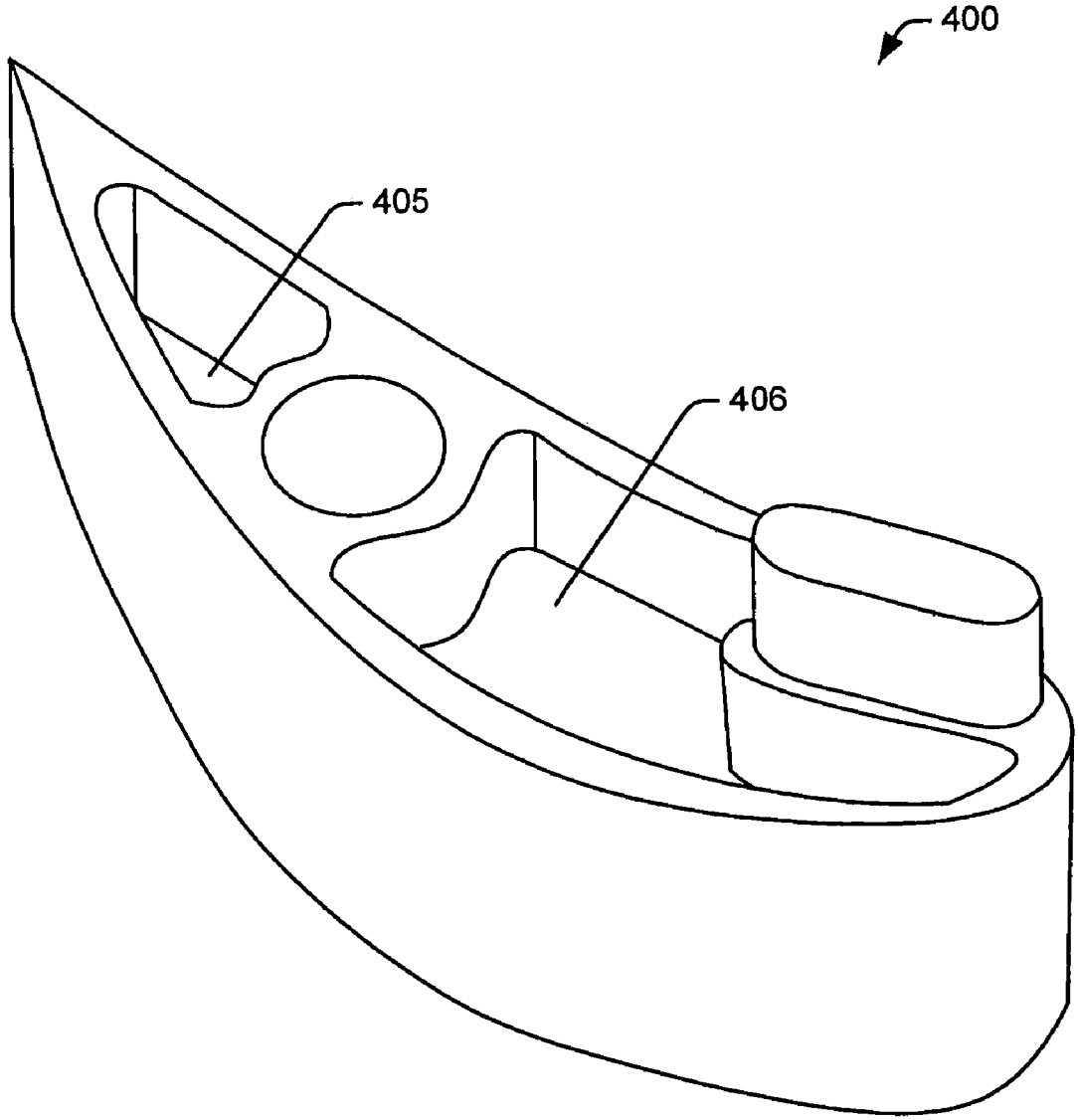
FIG. 4 (Prior Art)
FIG. 4 shows another prior art nozzle vane with cored-out construction.

FIG. 4 shows another prior art nozzle vane 400 with cored-out construction. As shown in FIG. 4, example nozzle vane 400 includes an aperture and an actuation tab similar to those in nozzle vane 300 shown in FIG. 3. However, the rear axial surface of nozzle vane 400 includes chambers 405-406, instead of solid surfaces. The chambers are cored-out sections in nozzle vane 400 and allow nozzle vane 400 to be manufactured with less cost and weight than a comparable solid vane. The front axial surface of nozzle vane 400 may also include other chambers (not shown) similar to chambers 405-406. The chambers in nozzle vane 400 are isolated from one another and may be pressurized by the exhaust gas surrounding nozzle vane 400 to different pressures. The analysis has shown that the differential pressures within cored-out nozzle vane 400 still generate significant axial loading on the unison ring.

Figure 5:
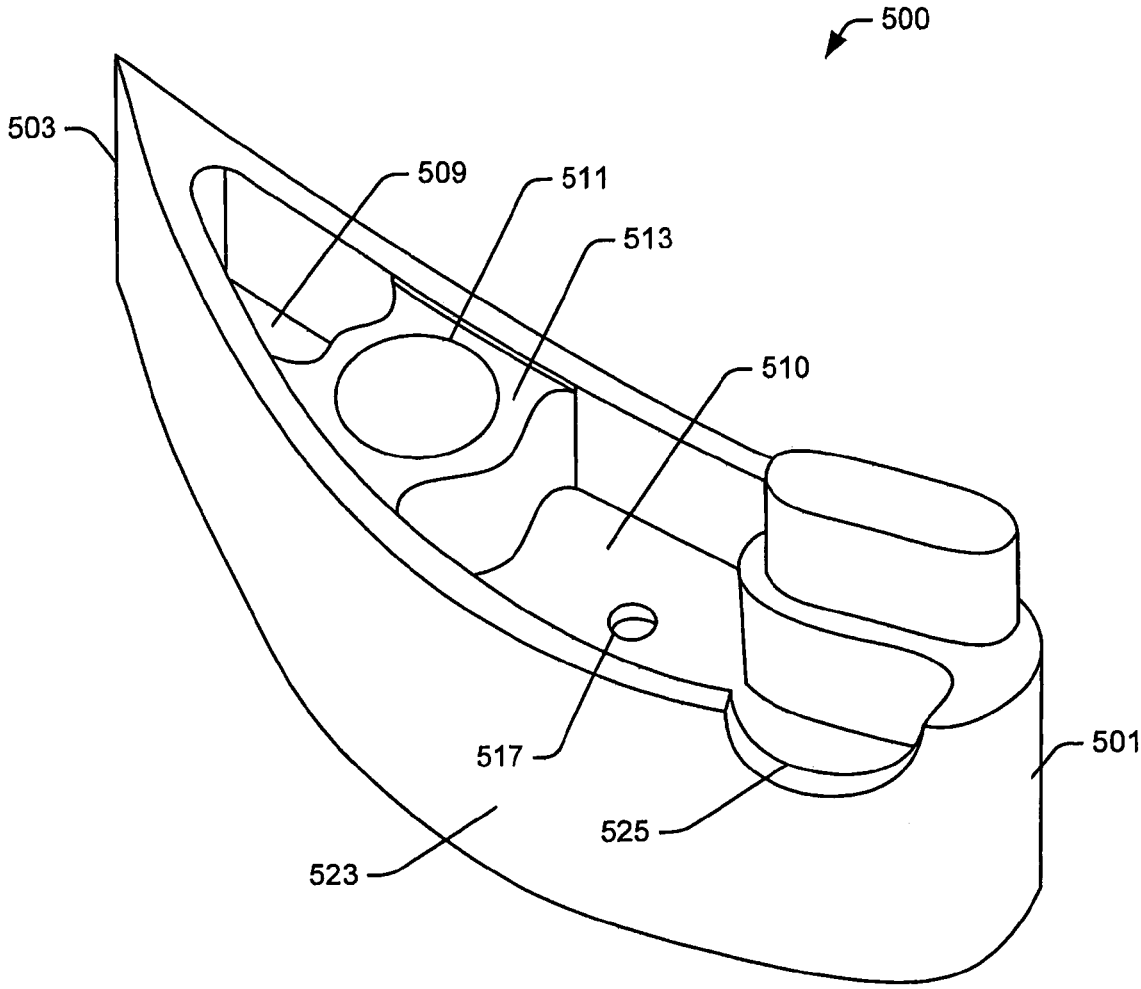
FIG. 5 shows an example nozzle vane with axial loading reduction features.

FIG. 5 shows an example nozzle vane 500 with axial loading reduction features. Nozzle vane 500 includes a leading edge 501, a trailing edge 503 and chambers 509-510 similar to those in nozzle vane 400 shown in FIG. 4. However, nozzle vane 500 also includes recess 513, aperture 517, and notch 525 more proximate the leading edge 501 than the trailing edge 503.

Notch 525 provides a passage on outer airfoil surface 523 that enables gas with turbine inlet pressure from outside the nozzle vane 500 to enter and pressurize chamber 510. The resulting pressure in chamber 510 can produce a counter-acting force that reduces the axial loading from nozzle vane 500 onto the unison ring. Notch 525 may occupy from approximately 0.1% to approximately 10% of outer airfoil surface 523. Notches that occupy greater percentages are also possible. Other notches on the outer airfoil surface 523 may also be used to pressurize the chamber 510 or other chambers in nozzle vane 500.

Recess 513 provides a passage for gas to move between chamber 509 and chamber 510 and serves to somewhat equalize the pressure between the two chambers. Although FIG. 5 only shows recess 513 in the rear axial surface, another recess may also be included in the front axial surface to equalize pressure in the chambers on that surface. In an exemplary vane constructed from stainless steel, the depth of recess 513 may range from about 0.1% to about 20% of the diameter of shaft opening 511. In general, structural integrity, wear couple between components and nature of the pivot mechanism or joint may be considered in determining the depth of the recess. As discussed further below, an exemplary vane that includes an integral post for pivoting the vane may include one or more passages adjacent the post or through the post.

Aperture 517 provides a passage between chamber 510 on the rear axial surface and the corresponding chamber on the rear axial surface (not shown). For example, chambers on opposite axial surfaces are typically separate by a web. Aperture 517 may be implemented as an opening on the web. Aperture 517 enables gas to move between chambers on the front and rear axial surfaces and, thus, somewhat equalizes the pressures between the two chambers. Aperture 517 may include about 0.1% to about 100% of the area on the rear axial surface occupied by the chamber 510. With respect to the upper end of this aperture range, structural integrity of the vane may be considered. For example, where appropriate, a cross-member extending between walls of a single open chamber may add structural integrity. Other apertures may also be used to equalize pressures between other chambers on the front and rear axial surfaces.

It is to be understood that recess 513, aperture 517 and notch 525 are axial loading reduction features that can be used on a nozzle vane to reduce axial loading on the unison ring. Recess 513, aperture 517 and notch 525 may be used independently or in conjunction with one another, depending on the configuration of the nozzle vanes and the other components in the turbocharger. An analysis for an example turbocharger has shown that these axial loading reduction features can significantly reduce axial loading on the unison ring. The data of this analysis will be discussed below in conjunction with FIG. 6.

Figure 6:
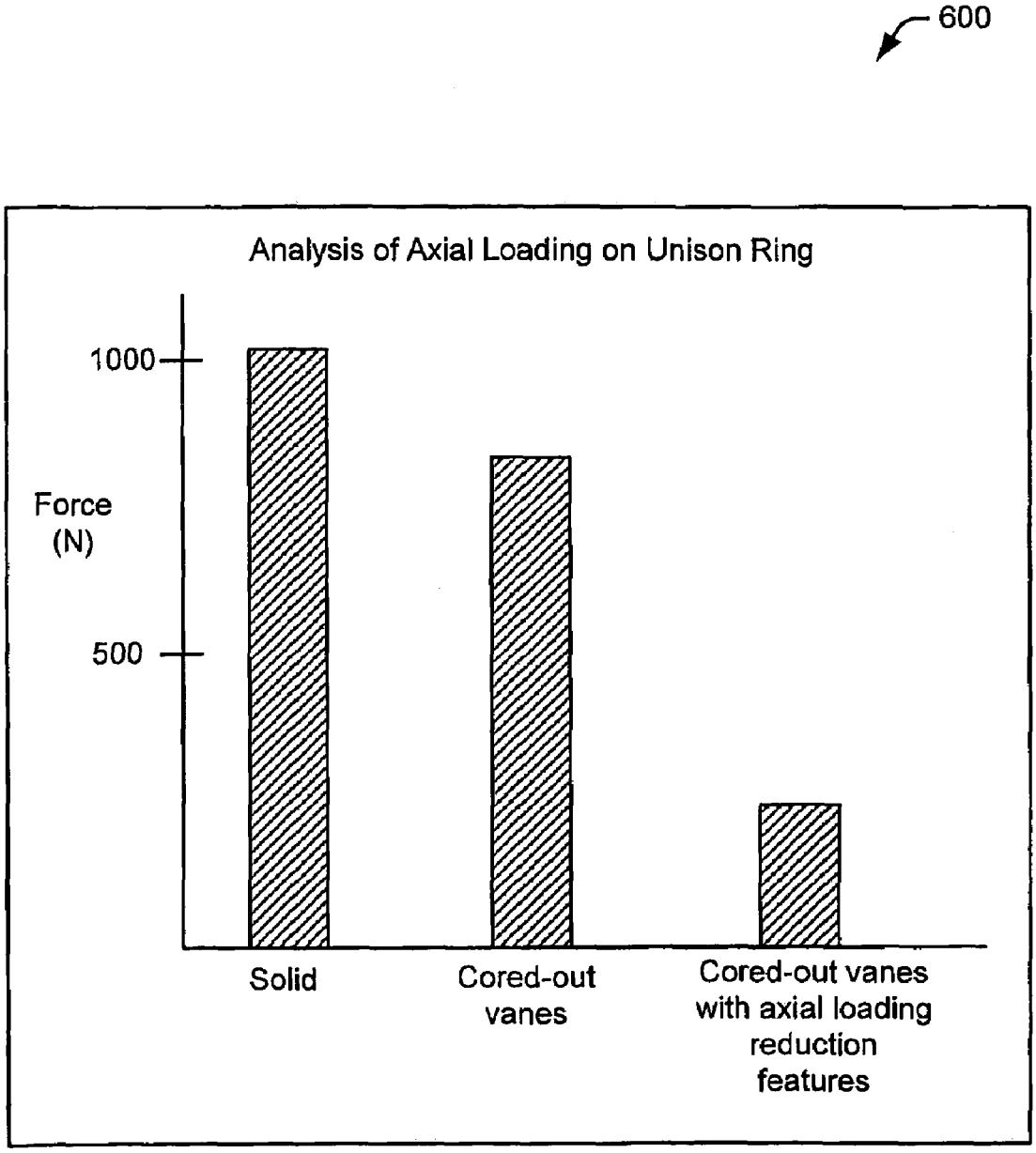
FIG. 6 shows data from an example unison ring axial loading analysis.

FIG. 6 shows data from an example unison ring axial loading analysis. The data in graph 600 shows calculated axial forces that are exerted on the unison ring for nozzle vanes with different geometries. Graph 600 shows that nozzle vanes with a solid construction, such as nozzle vane 300 in FIG. 3, produce the highest axial loading on the unison ring. The axial loading for nozzle vanes with cored-out sections is somewhat less than that of the solid nozzle vanes but is still significantly high.

As shown in FIG. 6, cored-out nozzle vanes with axial loading reduction features produce the least amount of axial loading. The reduction features for the nozzle vanes associated with this analysis include a recess, an aperture and a notch, which are similar to the features shown in FIG. 5. In this particular analysis, the axial loading for the cored-out nozzle vanes with these axial loading reduction features is only about 25% of the axial loading for solid nozzle vanes.

Figure 7:
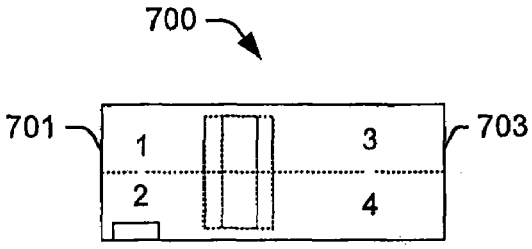
FIG. 7 shows a side view of an exemplary vane that includes four chambers and a notch.

FIG. 7 shows a side view of an exemplary vane 700 that includes four chambers (1, 2, 3 and 4) and a notch that opens to chamber 2. A passage exists between chambers 1 and 2, another passage exists between chambers 3 and 4 and yet another passage exists between chambers 2 and 4.

Figure 8:
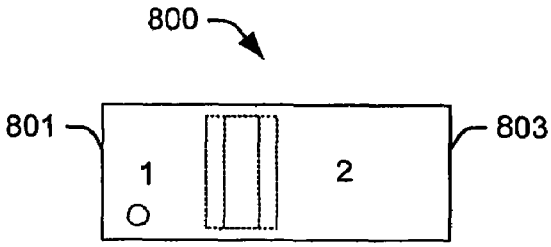
FIG. 8 shows a side view of an exemplary vane that includes two chambers and an opening on a side surface proximate to the leading edge of the vane.

FIG. 8 shows a side view of an exemplary vane 800 that includes two chambers and an opening on a side surface proximate to the leading edge of the vane that opens to a single chamber proximate to the leading edge 801 end of the vane 800. A passage exists as a recess adjacent an opening for a post or pivot mechanism that connects chamber 1 and 2.

Figure 9:
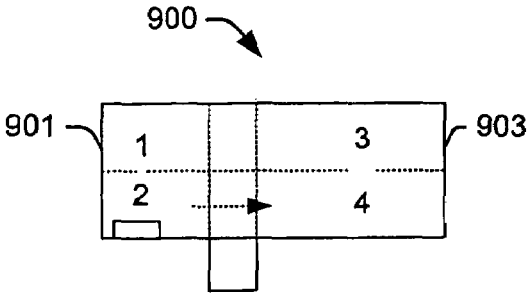
FIG. 9 shows a side view of an exemplary vane that includes a post where a passage exists adjacent the post or through the post.

FIG. 9 shows a side view of an exemplary vane 900 that includes a post where a passage exists adjacent the post or through the post to connect chamber 2 and 4.

Figure 10:
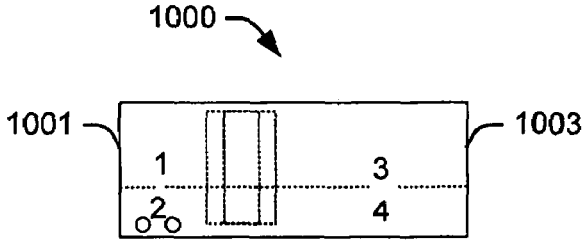
FIG. 10 shows a side view of an exemplary vane that includes a plurality of openings on a side surface proximate to the leading edge of the vane.

FIG. 10 shows a side view of an exemplary vane 1000 that includes a plurality of openings on a side surface proximate to the leading edge of the vane that open to chamber 2 of the exemplary vane 1000. The exemplary vanes 700, 800, 900 and 1000 of FIGS. 7-10 show various features within the scope of the technology described herein. General features include, for example, leading edges 701, 801, 901 and 1001 as well as trailing edges 703, 803, 903 and 1003 (see FIGS. 7-10 and reference numerals 301 and 303 of FIG. 3 and 501 and 503 of FIG. 5). Exemplary vanes may include one or more of the general and/or exemplary features of the vanes 700, 800, 900 and 1000 or other features.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An adjustable nozzle vane of a turbocharger comprising:

a first chamber oriented adjacent to a first axial surface on the nozzle vane, the first axial surface oriented adjacent to a unison ring configured to actuate the nozzle vane;

a second chamber oriented adjacent to a second axial surface, the second axial surface oriented opposite the first axial surface;

a first passage between the first and second chambers wherein the first passage enables gas flow between the first and second chambers and at least partially equalizes pressures between the first and second chambers; and a second passage between the first chamber and an area outside the adjustable nozzle vane wherein the second passage enables gas flow from the area into the first chamber and wherein pressure from the gas flow into the first chambers generates a force acting on the adjustable nozzle vane.

2. The adjustable nozzle vane as recited in claim 1, wherein the first passage is an aperture on a web separating the first and second chambers.

3. The adjustable nozzle vane as recited in claim 1, wherein the second passage is a notch on an airfoil surface of the adjustable nozzle vane.

4. The adjustable nozzle vane as recited in claim 1, wherein the force is acting in a direction away from the unison ring.

5. A variable geometry turbocharger comprising:

a turbine housing having an inlet, a volute connected to the inlet, a nozzle wall adjacent to the volute and an outlet, the turbine housing being arranged to accept exhaust gas from an engine through the inlet and to radially distribute the exhaust gas through the volute;

a turbine within the turbine housing;

a plurality of vanes arranged within the turbine housing between the volute and the turbine, the vanes being oriented to direct the exhaust gas from the volute to the turbine, each vane comprising:

a first chamber adjacent to a first axial surface, the first axial surface oriented adjacent to the nozzle wall;

a second chamber adjacent to a second axial surface, the second axial surface being opposite and parallel to the first axial surface;

a first passage between the first chamber and the second chamber wherein the first passage enables exhaust gas flow between the first chamber and the second chamber and wherein the exhaust gas flow at least partially equalizes pressures in the first and second chambers; and a second passage between the second chamber and an area outside the vane wherein the second passage enables exhaust gas to flow into the second chamber.

6. The variable geometry turbocharger as recited in claim 5, further comprising a unison ring oriented adjacent to the vanes and configured to control the orientation of the vanes in a uniform manner, the unison ring receiving an axial load exerted by the vanes and the exhaust gas passing between the vanes.

7. The variable geometry turbocharger as recited in claim 5, wherein the first passage occupies from approximately 0.1% to approximately 100% of an area on the second axial surface occupied by the second chamber.

8. The variable geometry turbocharger as recited in claim 5, wherein each vane further comprises:

a third chamber adjacent to the second axial surface; and a third passage connects the third chamber to the second chamber wherein the third passage enables exhaust gas flow between the second chamber and the third chamber and at least partially equalizes pressures in the second and third chambers.

9. The variable geometry turbocharger as recited in claim 8, wherein each vane further comprises an aperture adjacent to the second axial surface and wherein the third passage is implemented as a recess on the second axial surface.

10. The variable geometry turbocharger as recited in claim 5, wherein each vane further comprises:

an inner airfoil surface oriented adjacent to the turbine; and an outer airfoil surface oriented opposite to the inner airfoil surface;

wherein the second passage is a notch on the outer airfoil surface.

11. The variable geometry turbocharger as recited in claim 10, wherein the notch occupies from approximately 0.1% to approximately 10% of the outer airfoil surface.

12. A variable geometry turbocharger comprising:

a turbine housing having an inlet, a volute connected to the inlet, a nozzle wall adjacent to the volute and an outlet, the turbine housing being arranged to accept exhaust gas from an engine through the inlet and to radially distribute the exhaust gas through the volute;

a turbine within the turbine housing;

a plurality of nozzle vanes arranged within the turbine housing between the volute and the turbine, the nozzle vanes being oriented to direct the exhaust gas from the volute to the turbine, each of the nozzle vanes comprising:

a first chamber adjacent to a first axial surface;

a first passage connecting the first chamber to an area outside the nozzle vane wherein the first passage allows the exhaust gas to enter the first chamber and wherein pressure of the exhaust gas in the first chamber creates a counteracting force that reduces an axial load exerted by a respective one of the nozzle vanes;

a second chamber adjacent to a second axial surface oriented opposite the first axial surface;

a second passage between the first and second chambers wherein the second passage enables exhaust gas flow between the first and second chambers and at least partially equalizes pressures in the first and second chambers;

a third chamber adjacent to the first axial surface;

a fourth chamber adjacent to the second axial surface; and a third passage between the third and fourth chambers wherein the third passage enables exhaust gas flow between the third and fourth chambers and at least partially equalizes pressures in the third and fourth chambers.

13. The variable geometry turbocharger as recited in claim 12 further comprising a unison ring oriented adjacent to the nozzle vanes and configured to control the orientation of the vanes in a uniform manner, the unison ring receiving an axial load exerted by the nozzle vanes and the exhaust gas passing between the nozzle vanes.

14. The variable geometry turbocharger as recited in claim 12, wherein the nozzle vane further comprises a fourth passage between the first and third chambers and wherein the fourth passage enables exhaust gas flow between the first and third chambers and at least partially equalizes pressures in the first and third chambers.

15. The variable geometry turbocharger as recited in claim 12, wherein the nozzle vane further comprises a fourth passage between the second and fourth chambers and wherein the fourth passage enables gas flow between the second and fourth chambers and at least partially equalizes pressures in the second and fourth chambers.

* * * * *